United States Patent [19]

Deutsch et al.

[11] 4,104,356

[45] Aug. 1, 1978

[54] TILT-UP PANEL BRACKET

[76] Inventors: Joseph Paul Deutsch, 21 Almond Tree La., Irvine, Calif. 92664; Ray A. Jones, 9760 Lemon Ave., Alta Loma, Calif. 91701

[21] Appl. No.: 762,602

[22] Filed: Jan. 26, 1977

[51] Int. Cl.[2] ..... E04B 1/40

[52] U.S. Cl. ..... 264/297; 52/745; 249/219 R; 264/34; 264/334

[58] Field of Search ..... 264/34, 71, 297, 336, 264/334; 249/219; 52/745

[56] References Cited

U.S. PATENT DOCUMENTS 3,609,935 10/1971 Thomas ..... 52/745

OTHER PUBLICATIONS

Construction Methods and Equipment, pp. 52–53, May, 1956.

*Primary Examiner*—Thomas P. Pavelko

*Attorney, Agent, or Firm*—Knobbe, Martens, Olson, Hubbard & Bear

[57] ABSTRACT

An improved reusable bracket for securing wood forms for the pouring of concrete tilt-up panels has a base which is fastened to the concrete deck with a powder-driven fastener and an upstanding portion. The opposite side edges of the bracket abut the forms for two adjacent panels. Tabs on the bracket have oblique holes for nailing the bracket to the form. The bracket can be removed by a single blow on the upstanding member.

5 Claims, 4 Drawing Figures

TILT-UP PANEL BRACKET

BACKGROUND OF THE INVENTION

A basic requirement for the construction of the concrete panel forms utilized in fabricating tilt-up wall panels is their reuseability in the subsequent fabrication of wall panels. The concrete forms are usually constructed from wood members nailed or bolted together to form the appropriate configuration for the wall panel. The removal of these forms from the cured concrete panel is a time consuming operation requiring extreme care in the extraction of the nails, bolts, or braces comprising same. If the wood side members are to be used again, all nails must be extracted prior to their use. The blocks of wood used to brace the wood forms in the proper configuration are usually broken upon their removal. Thus, the nails remaining in the wood forms must be extracted before said form members can be reused. Since the bracing blocks were broken, replacements are required.

SUMMARY OF THE INVENTION

A particular object of the invention described herein is to provide a bracket which can be easily attached and detached without damage to the wood members comprising a concrete form used for pouring wall panels on a flat floor surface, which panels are subsequently tilted to an upright position on a prepared building foundation.

The preferred embodiment of the invention comprises a steel angle iron section with a plurality of holes to permit easy attachment to the wood side frames of the concrete forms and the floor slab on which the wall panel is poured. A novel nail extraction feature incorporated in the design of said bracket automatically removes all nails and fasteners used in the preliminary assembly of the concrete form when said brackets are pried from the floor slab.

These and other advantages of the present invention are best understood through a reference to the drawings, in which.

DETAILED DESCRIPTION OF THE PREFERRED EMBODIMENT

Figure 1:
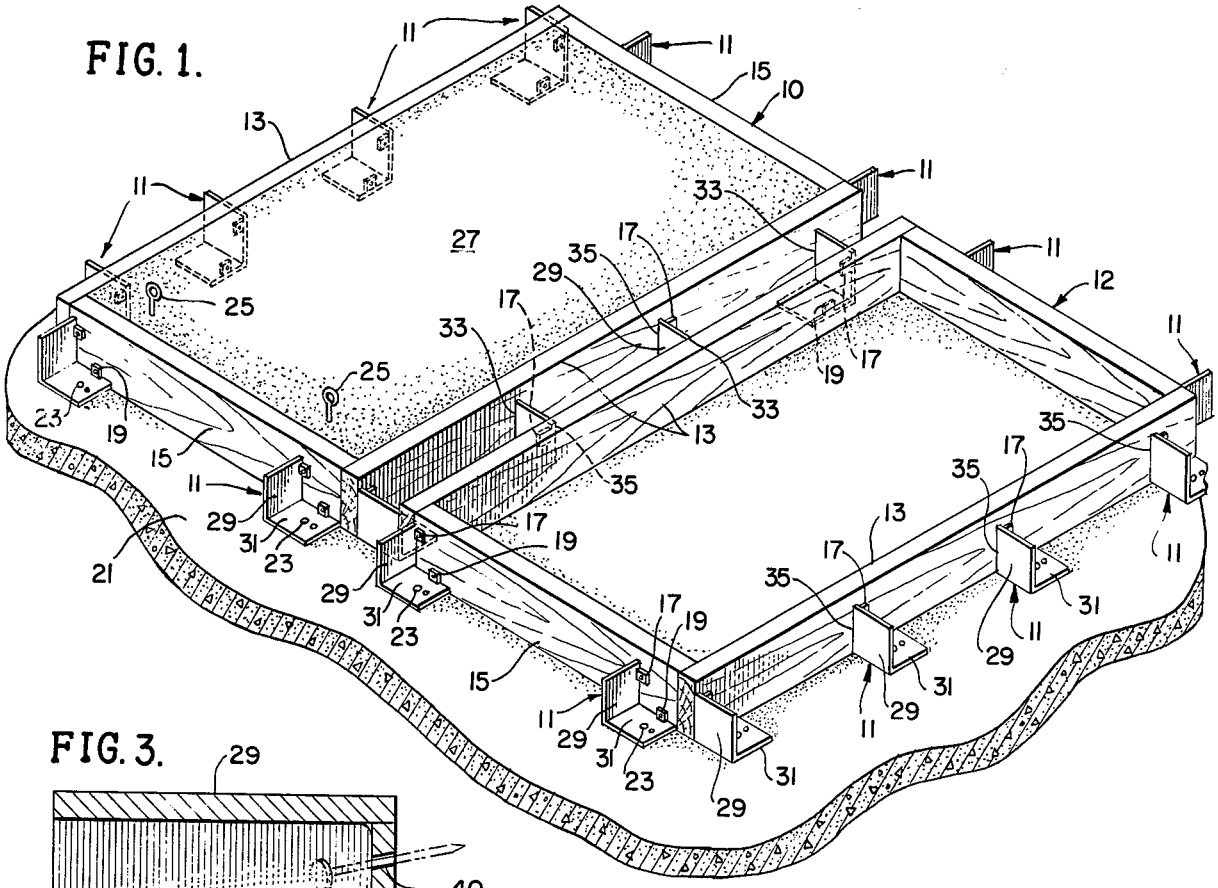
FIG. 1 is a perspective view of two concrete forms assembled adjacent to each other and utilizing the tilt-up panel brackets in their construction.

Referring initially to FIG. 1, two wood-framed concrete forms 10 and 12, substantially of rectangular configuration, utilizing the improved brackets 11 are shown. The sides 13 and ends 15 of the concrete form 10 are squared and aligned on a previously poured concrete slab 21 adjacent to the foundation of the building, and the brackets 11 are secured to the slab 21 and to the forms. Eyebolts 25 integrally attached to the steel reenforcement rods (not shown) comprising the concrete tilt-up slab 27 are provided to facilitate the tilt-up operation after the form 10 is removed.

Figure 3:
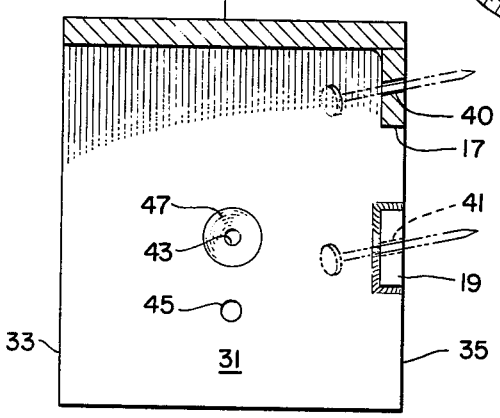
FIG. 3 is a sectional view of the bracket taken along lines 3—3 on FIG. 2.
Figure 2:
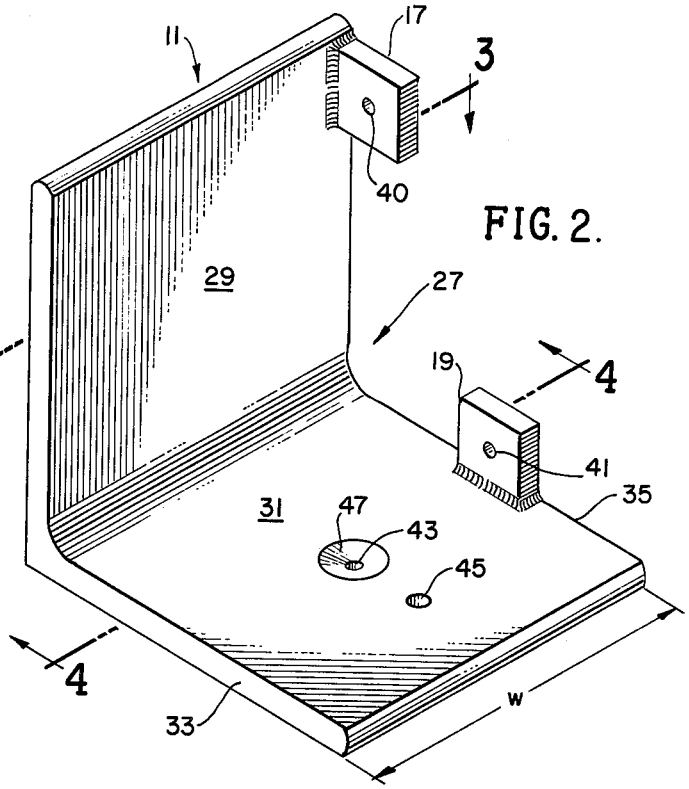
FIG. 2 is a perspective view of a single panel bracket.
Figure 4:
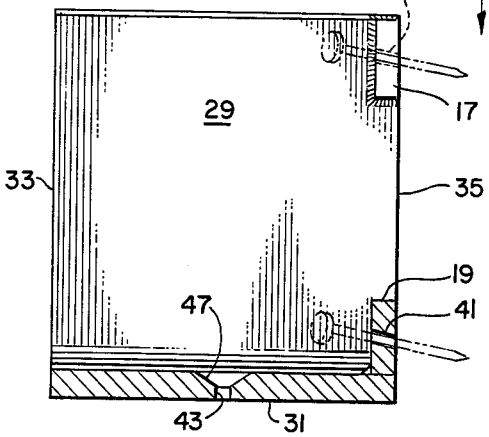
FIG. 4 is a sectional view of the bracket taken along lines 4—4 on FIG. 2.

Referring now to FIGS. 2–4, the panel bracket 11 is shown in detail. The bracket 11 comprises a body 27 made from a steel angle iron having an upright plate 29 and a base plate 31 of substantially the same size. The edges 33 and 35 are cut square in all respects to the main body portion 27 and are parallel to each other. The width W is identical for all of the brackets 11. A pair of tabs 17 and 19 are welded flush to the edge 35 of the upright plate 29 and base plate 31, respectively. Holes 40,41, centrally located in the tabs 17,19, are drilled at a compound angle to the edge 35 of bracket 11 as best shown in FIGS. 3 and 4. Actually the holes 40,41 are not parallel to the plane of either of the plates 29 or 31, but are oblique to both those plates, both the holes 40,41 extending rearward and downward.

A counter-sunk hole 43 is centrally located in the base plate 31. A second hole 45, of slightly larger diameter, is located on the same center line on which hole 43 is drilled in the base plate 31.

The use of the brackets 11 will now be described in detail. The concrete form members 13 and 15 are placed on the concrete floor slab 21 on edge in an upright position. A plurality of brackets 11 are spaced lengthwise along the sides of said members 13,15 with the base plates 31 resting on the concrete floor 21 and the bracket edge 35 with the tabs 17,19 firmly abutted against the sides of the form members 13,15. Nails are driven through the slanted holes 40,41 in the tabs 17 and 19 to secure the wood form members 13,15 to the edge 35 of the bracket 11. The form members 13 and 15 are thus held in a precise vertical position in relation to the surface of the concrete slab 21. The form members 13,15 are properly positioned and the corners squared to the dimensional requirements for the tilt-up concrete panel 27, having a rectangular configuration in this case, and secured to the floor slab 21 by concrete fasteners 23 driven through the counter-sunk hole 43 in the base plate 31 by a powder-actuated ram gun. An optional anchoring method is to use the second hole 45 as a guide for a masonry drill bit whereby several nails can be driven into the hole after it has been drilled.

An adjacent concrete form 12, preassembled in the same manner as described above, is abutted to the opposite edges 33 of brackets 11 of the primary concrete form 10 and secured in place to the floor slab 21 in the same manner. The squared edges 33 of the brackets 11 are not attached to the form 12 since the nailing tabs 17,19 are provided on the opposite edge 35 only. Thus, the alternate brackets spaced along the adjoining lengths of the concrete forms 10 and 12 are reversed in position, each bracket being attached to the form member 13 by means of the tabs 17,19. The abutting edges 33 of the alternate brackets 11 provide intermediate bracing to the member 13 to maintain said member straight. Since the main load pressure on the sides 13 of the form 12 is in an outward direction when the wet concrete mix is poured therein, the concrete itself pushes the side 13 thereof against the brackets.

When the poured concrete panels 27 are cured, the forms 10 and 12 are stripped from the concrete floor 21 by means of long pry bars or by blows of a sledge hammer directed at the back side of upright plate 29. Since the nail holes 40,41 in the tabs 17,19 are disposed at a compound angle, the nails securing said brackets 11 to the sides and ends 13,15 respectively, are pulled from the wood forms without damage, permitting their re-use in the progressive construction of the tilt-up wall panels. The conical counter-sinking 47 of the centrally located aperture 43 in the base plate 31 is self-centering thus facilitating the use of a powder-actuated ram gun for driving the fastener into the concrete floor 21. The fact that nailing tabs 17,19 are provided on one edge 35 only, permits the brackets 11 to be stacked in a nesting position for storage purposes.

Each of the holes 40,41 are obliquely directed relative the tabs 17 and 19. Specifically, as viewed in FIG. 2, each of the holes 40,41 is directed downwardly and rearwardly as it passes from the inside of the angle iron 11 to the outside. This oblique direction of the holes 40,41 is important since it guides the nails which are driven through the holes 40,41 to pass downwardly into the wooden forms 13,15 and in a direction into the wooden forms 13,15 toward the vertical leg 29 of the angle iron 11. This direction, of course, facilitates hammering the nails in the forms 13,15 but, more importantly, permits the removal of the nails from the wood forms by a sharp hammer blow to the vertical leg 29 of the angle iron 11. Such a hammer blow will tend to move the angle iron 11 in a plane which is parallel to the wooden form member to which it is attached. If the nails passed perpendicularly through the tabs 17 and 19, such a blow would tend to shear the nails rather than remove them. With the holes drilled obliquely, however, a hammer blow to the vertical member 29 will present a substantial force vector along the axis of the nails so that the blow will draw the nails from the wooden form members. Thus, after the concrete has been poured and cured, workmen may simply strike each of the brackets 11 with a sledge hammer to remove the brackets from the wooden forms, and at the same time remove all of the nails from the wooden forms so that the wooden forms are ready to use again without additional labor.

In summary, there has been described an improved tilt-up panel bracket, the application of which in conjunction with wood concrete forms for tilt-up panels permits the re-use of the wood members comprising said forms without prior cleaning or extraction of old nails. The brackets support the frame members in an upright position during the pouring operation and permit the easy removal of the form members when the concrete is cured. The brackets have a self-contained nail extraction feature which permits the repeated use of the wood form members without preparation for subsequent concrete pouring operations. The design of the bracket enables it to be nested with others in a compact manner for storage.

What is claimed is:

1. A method of forming a tilt-up, concrete wall panel, comprising:

aligning wood form members on a horizontal slab of set concrete to define the length and width of a tilt-up concrete wall panel, said panel being shorter and narrower than said slab;

placing a plurality of angle iron members in abutment with the exterior surfaces of said wood form members, each of said angle iron members having a horizontal and vertical leg each of which abuts said wood form members, said angle iron members oriented so that said vertical leg extends outwardly from the adjacent wood form member in a plane perpendicular thereto;

driving a nail through a pilot hole in a tab provided on one of said vertical and horizontal legs of each of said angle iron members into said wood form members;

attaching said horizontal leg of each of said angle iron members to said horizontal slab using easily removable attachment means;

pouring concrete into the form provided by said wood form members to form a tilt-up wall section; and after said tilt-up wall section has cured, removing said wood form members by removing said angle iron members, said nails, and the means attaching said horizontal leg of said angle iron members in one operation by jarring said angle iron members away from said horizontal slab of concrete.

2. A method of forming tilt-up concrete wall panels as defined in claim 1 wherein said step of driving said nail comprises driving said nail through an oblique pilot hole in said tab so that said nail enters said wood form members at an oblique angle facilitating removal of said nail.

3. A method of forming tilt-up concrete wall panels as defined in claim 1 wherein said step of attaching said horizontal leg comprises driving powder-driven nails through each of said angle iron members into said horizontal slab.

4. A method of forming tilt-up concrete wall panels as defined in claim 1 wherein said removing step comprises jarring said angle iron with a hammer blow to remove said nails and said means attaching said horizontal leg of said angle iron members in a single operation.

5. A method of forming tilt-up concrete wall panels as defined in claim 1 additionally comprising:

after placing said plurality of angle iron members in abutment with the exterior surfaces of said wood form members, placing additional wood form members in abutment with the opposite ends of said angle iron members, said additional wood form members being used for the formation of a second concrete wall panel and being supported by said same plurality of angle iron members.

* * * * *